United States Patent [19]

Ushirogata

[11] Patent Number: 4,900,004

[45] Date of Patent: Feb. 13, 1990

[54] SHEET FEEDER

[75] Inventor: Yoshiaki Ushirogata, Tokyo, Japan

[73] Assignee: Ricoh Company, Ltd., Tokyo, Japan

[21] Appl. No.: 219,369

[22] Filed: Jul. 15, 1988

[30] Foreign Application Priority Data

Jul. 15, 1987 [JP] Japan ..... 62-176597[U]

[51] Int. Cl.[4] ..... B65H 9/12

[52] U.S. Cl. ..... 271/121; 271/126; 271/241

[58] Field of Search ..... 271/241, 233, 125, 122, 271/121, 126, 171, 157, 147

[56] References Cited

U.S. PATENT DOCUMENTS

| | | | |
|---|---|---|---|
| 3,995,952 | 12/1976 | Schoppe | 271/122 X |
| 4,171,129 | 10/1979 | Daley et al. | 271/126 X |
| 4,444,383 | 4/1984 | Crislip et al. | 271/157 X |
| 4,461,466 | 7/1984 | Uchida et al. | 271/126 X |

*Primary Examiner*—Joseph J. Rolla
*Assistant Examiner*—David H. Bollinger
*Attorney, Agent, or Firm*—Oblon, Spivak, McClelland, Maier & Neustadt

[57] ABSTRACT

A sheet feeder for an electrophotographic copier or like image forming apparatus includes a structure for aligning the trailing edges of a large amount of paper sheets which are stacked on a tray. The structure includes a back fence mounted on a transmission member which is stretched in the widthwise direction of the sheets. The back fence is movable in the widthwise direction of the sheets between an operative position for aligning the trailing edges of the sheets and an inoperative direction for facilitating the supply of sheets onto the tray. The movement of the back fence between the operative and inoperative positions is interlocked with the upward and downward movements of the tray.

4 Claims, 4 Drawing Sheets

SHEET FEEDER

BACKGROUND OF THE INVENTION

The present invention relates to a sheet feeder for an electrophotographic copier or like image forming apparatus and, more particularly, to a sheet feeder with a structure for aligning the trailing edges of a large amount of sheets which are stacked on a tray.

In an image forming apparatus such as an electrophotographic copier, it is a common practice to feed a plain paper sheet or similar sheet to a photoconductive element which carries a developed image thereon or to a transfer element to which an image is to be transferred from the photoconductive element, thereby producing a copy. A sheet feeder is associated with an image forming apparatus for implementing such sheet feed. To cope with the current tendency toward a greater number of copies, a sheet feeder capable of accommodating a large amount of paper sheets at a time has recently come into the market.

A prior art sheet feeder is located in the vicinity of a sheet feed section of an image forming apparatus. The sheet feeder is generally made up of an elevatable tray which is loaded with a stack of paper sheets, and a separating mechanism for feeding the sheets one by one from the tray toward the sheet feed section of the image forming apparatus. The separating mechanism is constituted by a draw-out roller located at a sheet draw-out position above the tray for feeding the sheets from the tray, and a separation roller pair for driving only the uppermost one of the sheets drawn out by the draw-out roller toward the sheet feed section by separating it from the others. The separation roller pair comprises an upper roller rotatable in the same direction as an intended direction sheet feed and a lower roller rotatable in the opposite direction to the same. When a plurality of paper sheets are fed together by the draw-out roller, the upper roller drives the uppermost sheet toward the sheet feed section while, at the same time, the lower roller returns the other sheets toward the tray.

The prior art sheet feeder described above has the following shortcoming. When the returning force exerted by the lower roller on the sheets becomes greater than the frictional force acting between those sheets, the trailing edges, or leading edges as viewed in the returning direction, of the sheets fail to be aligned with the trailing edges of other sheets which have been left on the tray. As such sheets returned to the tray are fed by the draw-out roller again, the amount of feed by the draw-out roller or the amount of transport by the separation roller pair is varied to in turn disturb the registration timing. This results in incomplete sheet feed and therefore sheet jams.

While various implementations for eliminating incomplete sheet feed as stated above have been proposed, none of them is operable in a satisfactory manner.

SUMMARY OF THE INVENTION

It is therefore an object of the present invention to provide a sheet feeder for an image forming apparatus having a structure for aligning the trailing edges of a large amount of paper sheets stacked on a tray and capable of aligning the edges of paper sheets which are to be fed again after being returned to the tray.

It is another object of the present invention to provide a generally improved sheet feeder.

A sheet feeder for feeding a large amount of paper sheets one at a time from a predetermined draw-out position of the sheet feeder of the present invention comprises a housing having a pair of side walls which are positioned parallel to an intended direction of sheet feed of the sheet feeder, a tray elevatably supported by the side walls and loaded with a stack of paper sheets, and an aligning device movable to an operative position for aligning trailing edges of the sheets on the tray when the tray is elevated and to an inoperative position for enabling the sheets to be loaded on the tray when the tray is lowered. The movements of the aligning means to the operative position and the inoperative position are respectively synchronous with a start of elevation and a start of lowering of the tray and respectively proceed at a higher rate than the elevation and the lowering of the tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
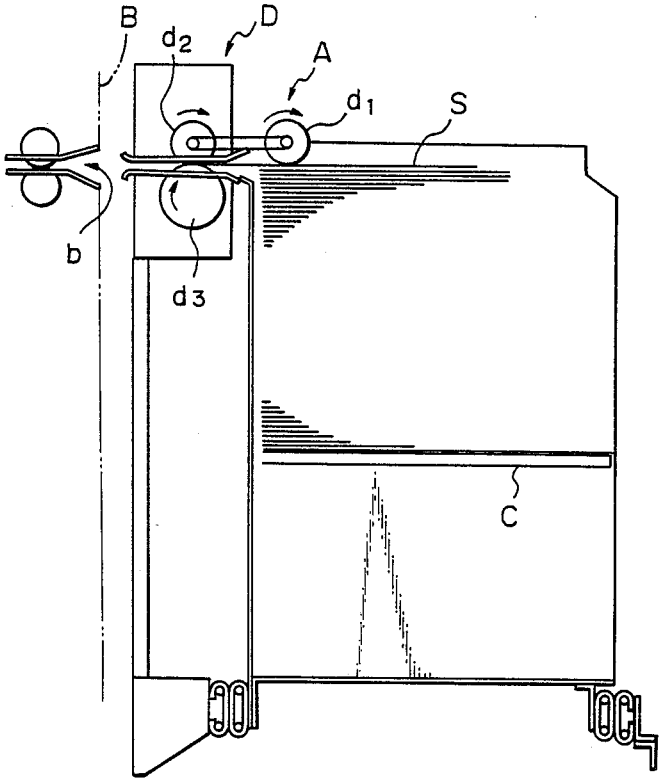
Fig. 1 PRIOR ART
FIG. 1 is a side elevation showing the arrangement of various members which are included in a prior art sheet feeder.

To better understand the present invention, a brief reference will be made to a prior art feeder associated with an image forming apparatus, shown in FIGS. 1 and 2. As shown, the sheet feeder A is positioned in the vicinity of a sheet feed section b of the housing of an image forming apparatus B and generally made up of an elevatable tray C and a separating mechanism D. The tray C is loaded with a stack of paper sheets S, and the separating mechanism D is adapted to feed the sheets S one at a time to the sheet feed section b of the apparatus B. The separating mechanism D includes a draw-out roller $d_1$ located at a sheet draw-out position of the sheet feeder A, and an upper roller $d_2$ and a lower roller $d_3$ which in combination serve to drive only the uppermost one of paper sheets S which are drawn out by the roller $d_1$ toward the sheet feed section b. While the upper roller $d_2$ is rotatable in a direction corresponding to an intended direction of sheet feed, the lower roller $d_3$ is rotatable in the opposite direction to the direction of sheet feed.

Figure 2:
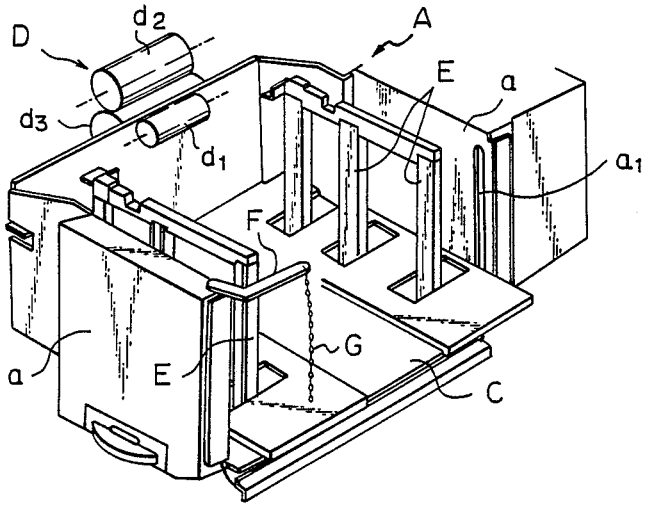
Fig. 2 PRIOR ART
FIG. 2 is a fragmentary perspective view of the sheet feeder of FIG. 1.
Figure 3:
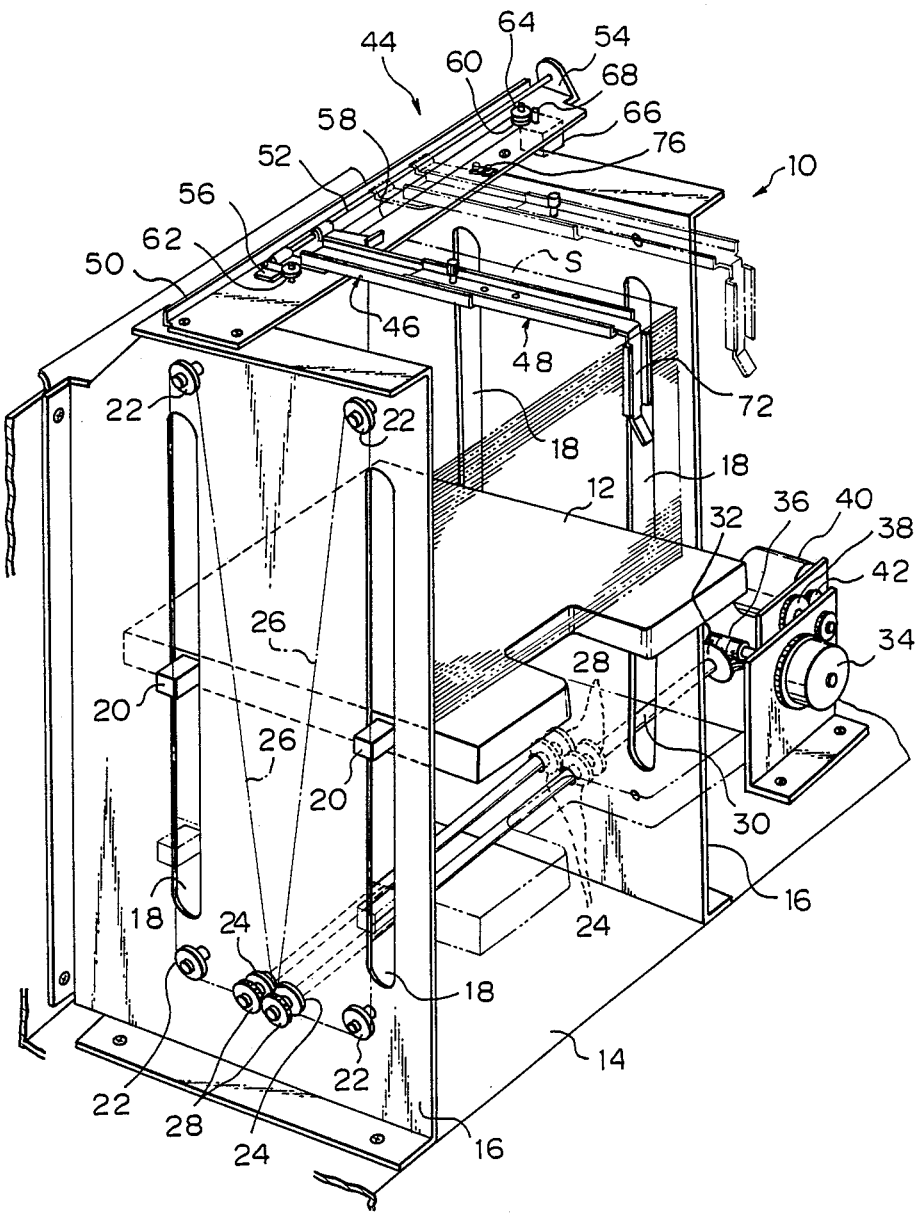
FIG. 3 is a perspective view showing a sheet feeder embodying the present invention.
Figure 4:
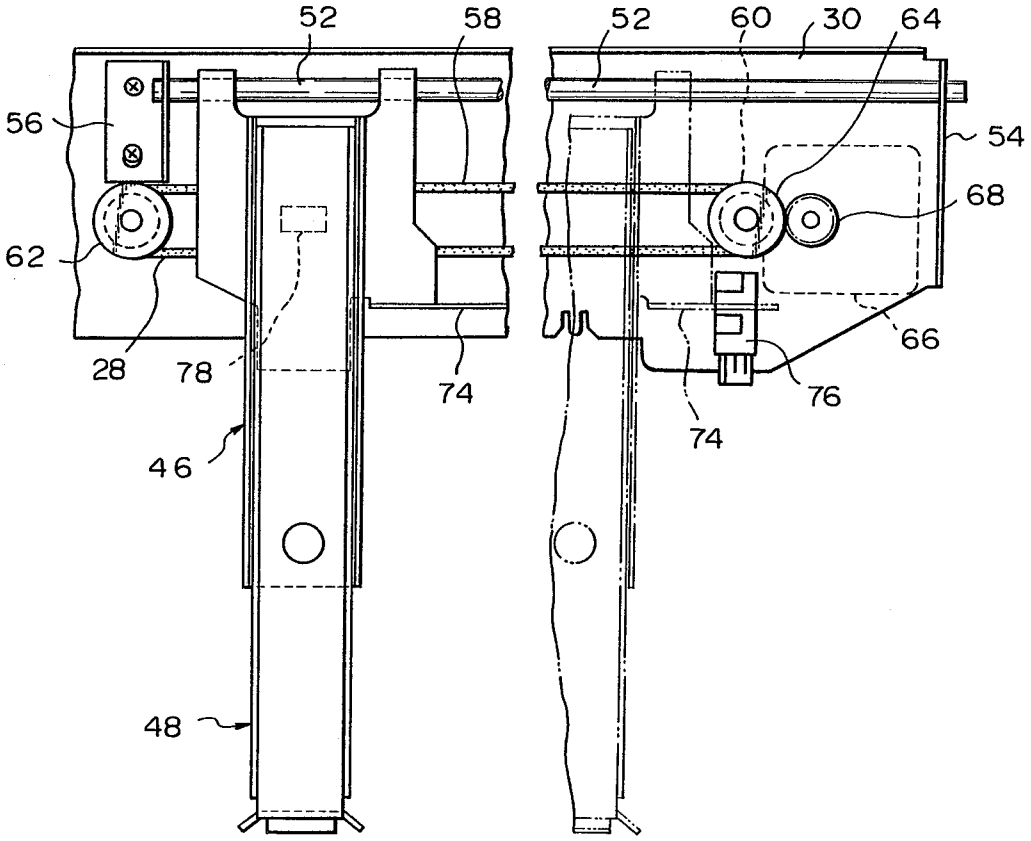
FIG. 4 is a fragmentary plan view of the sheet feeder of Fig. 3.

As shown in FIG. 2, side walls a of the sheet feeder A are each formed with a vertically long guide channel $a_1$. The tray C is provided with columnar portions (not shown) at opposite side edges thereof with respect to the direction perpendicular to the direction of sheet feed, i.e. to the widthwise direction of sheets S. The columnar portions are individually received in the guide channels $a_1$ so that the tray C is elevatable through a chain or a wire rope (not shown) which is fixed to the columnar portions. Also shown in FIG. 2 are members E for aligning the opposite side edges of the sheets S with respect to the widthwise direction of the sheets S.

In the sheet feeder A, the paper sheets S stacked on the tray C are drawn out by the roller $d_1$ toward the separating mechanism D. When some sheets S are drawn out together by the roller $d_1$, the separating mechanism D drives only the uppermost sheet in the intended direction of sheet feed while returning the others which underlie the uppermost sheet toward the tray C. Hence, the paper sheets S are fed one by one without fail.

While the paper sheets S other than the uppermost one are returned toward the tray C by the rotation of the lower roller $d_3$ of the mechanism D, the displacing force developed by the the rotation of the roller $d_3$ is apt to become greater than the frictional force acting between the sheets S. Then, the trailing edges, or leading edges as viewed in the returning direction, of those paper sheets S fail to be aligned with the trailing edges of sheets S which have been left on the tray C. This brings about a problem that since the leading edges of those returned sheets S are deviated from those of the others with respect to the draw-out roller $d_1$, the amount of draw-out by the rollers $d_1$ and the rollers $d_2$ and $d_3$ of the separating mechanism D differs from the returned sheets S to the sheets S left on the tray C. In such a condition, an accurate registration timing is unattainable resulting in incomplete sheet feed and therefore in a sheet jam. In the light of this, as shown in FIG. 2, the prior art sheet feeder A is provided with a lever F mounted on that part of the side wall a which corresponds to the trailing edges of the paper sheets S. The lever F is rotatable toward substantially the intermediate between the opposite sides of the sheet feeder A with respect to the widthwise direction of the sheets S. A chain G, for example, depends from the free end of the lever F so that the trailing edges of the returned sheets S may abut thereagainst.

A drawback with the above-described lever scheme is as follows. When paper sheets S are to be loaded on the tray C, the lever F is necessarily rotated to a position where it does not interfere with the sheet loading operation, i.e. with the sheets S. Hence, if the sheet feeder A is reconditioned for sheet feed without returning the lever F to the position where the chain G faces the leading edges of the sheets S, a sheet jam due to incomplete sheet feed will occur as previously stated.

Referring to FIGS. 3 to 6, a sheet feeder embodying the present invention is shown. The sheet feeder, generally 10, includes a separating mechanism D which is made up of a draw-out roller $d_1$ and a separating roller pair $d_2$ and $d_3$, as has been the case with the prior art sheet feeder A. A characteristic feature of the sheet feeder 10 is a back fence 44 which is mounted in an upper portion of the sheet feeder 10 and fulcrumed for rotation at the sheet draw-out side of the sheet feeder 10, as described in detail later.

A tray 12 is interposed between parallel side walls 16 of the sheet feeder 10 which extend upward from a bottom wall 14 of the sheet feeder 10. The side walls 16 are each formed with vertically long parallel guide slots 18. Projections 20 extend sideways from each of opposite side ends of the tray 12 with respect to the widthwise direction of sheets S and are individually received in and protrude from the guide slots 18 of the adjacent side wall 16. Driven pulleys 22 are rotatably mounted on the outer surface of each of the side walls 16 in the vicinity of the upper and lower ends of the guide slots 18. Drive pulleys 24 are mounted in a substantially intermediate portion of each side wall 16 with respect to an intended direction of sheet feed and in one-to-one correspondence with the guide slots 18. An elongate transmission member 26 in the form of a chain or a wire rope is passed over the driven pulleys 22 and drive pulleys 24, the ends of the projections 20 being rigidly connected to the transmission member 26. Intermeshing gears 28 are securely mounted on those shafts which support the drive pulleys 24. Mounted on an extension of one 30 of those shafts is a worm wheel 32. A worm 36 is mounted on an output shaft of a reduction gear 34 and held in mesh with the worm wheel 32. An input shaft of the reduction gear 34 is meshed through an intermediate gear 38 with a gear 42 which is mounted on an output shaft of a motor 40. Switches (not shown) are provided for selectively rotating the motor 40 in opposite directions so that the tray 12 may be raised and lowered as needed. The motor 40 is deenergized when the tray 12 actuates a switch (not shown) which is provided on the bottom wall 14 of the sheet feeder 10 and when the paper sheets S actuates a switch (not shown) which is disposed in the vicinity of the draw-out roller $d_1$.

The back fence 44 is positioned atop the side walls 16 to serve as means for aligning the trailing edges of the paper sheet S. Specifically, the back fence 44 is made up of a base member 46 and a regulating member 48. The base member 46 is provided on a support plate 50 whose lengthwise opposite ends are securely mounted on upper front portions of the side walls 16 with respect to the direction of sheet feed. One end of the base member 46 is movably mounted on a guide shaft 52 which extends in the lengthwise direction of the support plate 50. The guide shaft 52 is supported at one end by a bracket 54 which is located at one end of the support plate 50 and at the other end by a bracket 56 which is located at a substantially intermediate portion of the support plate 50, the intermediate portion being associated with substantially the intermediate between widthwise opposite edges of the paper sheets S. The base member 46 is rotatable about the guide shaft 52. Provided on the underside of the base member 46 is a belt 58 for moving the base member 46. The belt 58 is passed over a drive pulley 60 and a driven pulley 62 which are rotatably mounted on the support plate 50 in the vicinity of the brackets 54 and 56, respectively. The straight runs of the belt 58 each has a length which allows the base member 46 to move between an operative position and an inoperative position which are respectively indicated by a solid line and a phantom line in FIGS. 3 and 4. The operative position is such that the base member 46 is aligned with substantially the intermediate between widthwise opposite edges of the paper sheets S loaded on the tray 12 and faces the trailing edges of the sheets S. On the other hand, the inoperative position is such that the base member 46 is retracted to the vicinity of the inner surface of one of the side walls 16 to facilitate sheet loading operation.

A driven gear 64 is provided coaxially with the drive pulley 60 and held in mesh with a drive gear 68 which is in turn mounted on an output shaft of a motor 66. Implemented as a stepping motor, for example, this motor 66 is capable of rotating by a predetermined amount at a time. The motor 66 is provided with a timer which is electrically connected to the switches (not shown) each being adapted to feed an operation start signal to the motor 40, i.e. the switches for selectively rotating the motor 40 in opposite directions as previously stated. In response to an output of any of those switches, the motor 66 is continuously rotated for a predetermined period of time. This period of time is long enough for the drive motor 66 to rotate until the base member 46 arrives at any of the operative and inoperative positions. In this instance, the rotation speed of the motor 66 is such that the base member 46 reaches its operative position before the tray 12 loaded with a stack of sheets S is elevated to and stopped at the sheet feed position.

The regulating member 46 of the back fence 44 is constituted by a fastening portion 70 and a regulating portion 72 which extends downward from the fastening portion 70 to face the trailing edges of the paper sheets S. The fastening portion 70 is formed with a plurality of openings which are spaced apart in the direction of sheet feed. The fastening portion 70 is fastened to the base member 46 by a screw with any of the openings being aligned with a threaded hole which is formed through the free end of the base member 46. The openings of the fastening portion 70, therefore, each determines the amount of rearward projection of the fastening portion 70 relative to the base member 46. This allows the regulating portion 72 which depends from the fastening portion 70 to always face the trailing edges of sheets S with no regard to the size of the sheets S.

Figure 5:
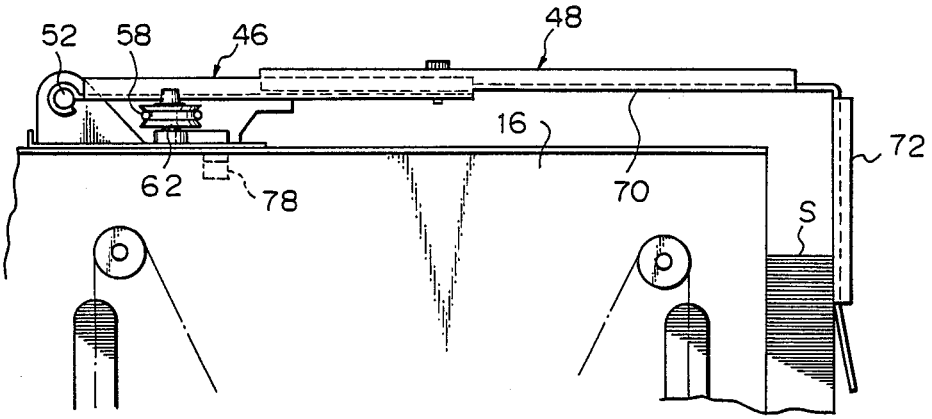
FIGS. 5 and 6 are side elevations representative of the operation of the sheet feeder as shown in FIG. 4.
Figure 6:
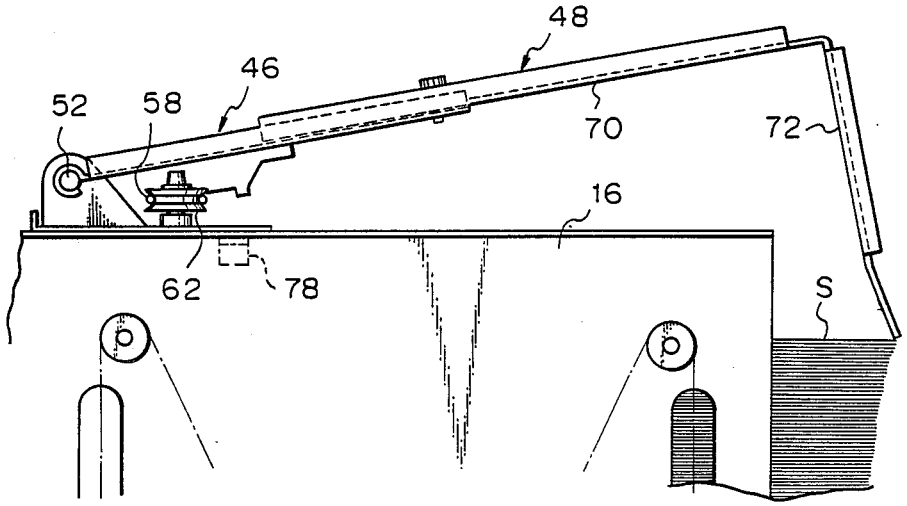

Members responsive to the operative and inoperative positions of the base member 46 are mounted on the support plate 50. Specifically, the base plate 46 is provided with a shutter piece 74 at one side thereof. In the operative or retracted position of the base member 46, the shutter piece 74 blocks an optical path of a photoelectric sensor 76 which is mounted on the support plate 50. Another photoelectric sensor 78 is mounted on the support plate 50 in such a manner that in the operative or aligning position of the base member 46 the sensor 78 receives which it emits and is reflected by the underside of the base member 46. As shown in FIGS. 5 and 6, the sensor 78 faces the underside of the base member 46 in the operative position of the latter and may include a light emitting portion and a light-sensitive portion to identify a relative position of the regulating member 48 which is unitary with the base member 46 and the sheets S in terms of the quantity of light incident to the light-sensitive portion. The quantity of light incident to the light-sensitive portion varies with the angular position of the base member 46.

In operation, to load the tray 12 with paper sheets S, one of the switches associated with the motor 40 is operated to rotate the motor 40 in the direction for lowering the tray 12. As a result, the chain or like elongate transmission member 26 is driven via the reduction gear 34 and gear 28 to lower the tray 12. Timed to the start of rotation of the motor 40, the motor 66 associated with the back fence 44 starts rotating to rotate the drive pulley 60 in the direction for moving the base member 46 from the operative position to the inoperative position. This moves the belt 58 and therefore the base member 46 until the sensor 76 senses the shutter piece of the base member 46. After the paper sheets S have been loaded on the tray 12, the other switch associated with the motor 40 is operated to drive it in the direction for elevating the tray 12. Consequently, the tray 12 is elevated by the transmission member 26 via the reduction gear 34 and gear 28. At this time, the motor 40 is deenergized when the switch located in the vicinity of the draw-out roller $d_1$ as previously stated is actuated by the sheets S.

When the switch for elevating the tray 12 is operated, the motor 66 is also energized to rotate for the predetermined period of time and at a higher speed than the elevation speed of the tray 12. Therefore, the belt 58 driven by the drive pulley 62 is moved to bring the base member 46 to the operative position before the sheets S actuates the switch near the draw-out roller $d_1$ to deenergize the motor 40. In the case that the drive pulley 62 associated with the back fence 44 continuously rotates until the sheets S on the tray 12 actuates the above-mentioned switch, the base member 46 remains in the operative position in abutment against the bracket 56 while, at the same time, the pulley 62 and the belt 58 slip on each other. Consequently, when the sheets S on the tray 12 operates the switch near the draw-out roller $d_1$, the regulating portion 72 of the regulating member 48 has already reached the position where it will face the leading edges of the sheets S. In such a position, the regulating portion 72 is ready to stop the trailing edges of sheets S which may be returned toward the tray 12 and to align the trailing edges of sheets S which may be sequentially raised in a predetermined position on the tray 12.

Assume that the regulating member 48 of the back fence 44 is held in the operative position, and that the paper sheets S are neatly stacked on the tray 12 which is being elevated with their trailing edges aligned, as shown in FIG. 5. Then, the regulating portion 72 of the member 48 which is projected in matching relation to the size of the sheets S does not interfere with the leading edges of the sheets S and, therefore, the quantity of light incident to the sensor 78 which faces the underside of the base member 46 does not change. As shown in FIG. 6, when the trailing edges of the sheets S on the tray 12 are not aligned, the regulating portion 72 interferes with the sheets S with the result that the regulating member 48 and therefore the base member 46 is raised about the guide shaft 52 by the sheets S. In this condition, the quantity of light incident to the sensor 78 changes. In this manner, the back fence 44 in the illustrative embodiment is rotatable to sense the condition in which the trailing edges of sheets S are not aligned, thereby eliminating incomplete sheet feed. Specifically, in such a condition, the sensor 78 produces an output signal for reversing the rotation of the motor 40 so that the tray 12 is returned to the lowered or sheet supply position.

In summary, in accordance with the present invention, a back fence is movable interlocked with a tray between an operative position where it faces the trailing edges of paper sheets and an inoperative position where it does not face them. The back fence, therefore, automatically faces the trailing edges of paper sheets on a tray when the tray is brought to a position for feeding the sheets, eliminating incomplete sheet feed ascribable to misalignment of the trailing edges of paper sheets.

Various modifications will become possible for those skilled in the art after receiving the teachings of the present disclosure without departing from the scope thereof.

What is claimed is:

1. A sheet feeder for feeding a large amount of paper sheets one at a time from a predetermined draw-out position of said sheet feeder comprising:

a housing having a pair of side walls which are positioned parallel to an intended direction of sheet feed of said sheet feeder;

a tray supported by said side walls by means for elevating and lowering, said tray being loaded with a stack of paper sheets; and aligning means movable to an operative position which corresponds to the trailing edges of the sheets for aligning the trailing edges of the sheets on said tray when said tray is elevated and to an inoperative position for enabling the sheets to be loaded on said tray when said tray is lowered, and drive means for selectively moving said aligning means to the operative position and the inoperative position thereof in a direction perpendicular to the intended direction of sheet feed and in synchronization with a start of elevation and a start of lowering of said tray, respectively, and at a higher rate than the elevation and the lowering of said tray.

2. A sheet feeder as claimed in claim 1, wherein said aligning means comprises a guide shaft located at the draw-out position and extending in a direction perpendicular to the intended direction of sheet feed, a base member rotatably mounted on said guide shaft and movable between the operative position and the inoperative position, and a regulating member fastened to said base member and projecting to a position which corresponds to the trailing edges of the sheets.

3. A sheet feeder as claimed in claim 1, further comprising a draw-out roller for drawing out the sheets on said tray from the draw-out position, and separating means for feeding uppermost one of the sheets drawn out by said draw-out roller by separating the uppermost sheet from the others.

4. A sheet feeder as claimed in claim 3, wherein said separating means comprises a separating roller pair which is constituted by an upper roller for feeding only the uppermost sheet and a lower roller for returning the other sheets to said tray.

* * * * *